US007788770B2

(12) United States Patent
Vitito et al.

(10) Patent No.: US 7,788,770 B2
(45) Date of Patent: Sep. 7, 2010

(54) HINGE FOR A MOBILE VIDEO SYSTEM

(75) Inventors: Christopher J. Vitito, Celebration, FL (US); Jeffrey D. Brawner, Tampa, FL (US)

(73) Assignee: Audiovox Corporation, Hauppauge, NY (US)

( * ) Notice: Subject to any disclaimer, the term of this patent is extended or adjusted under 35 U.S.C. 154(b) by 0 days.

(21) Appl. No.: 12/155,582

(22) Filed: Jun. 6, 2008

(65) Prior Publication Data

US 2009/0300883 A1 Dec. 10, 2009

(51) Int. Cl.
*E05C 17/64* (2006.01)

(52) U.S. Cl. ..... 16/341

(58) Field of Classification Search ..... 16/341; 267/154, 155, 157; 455/575.3, 575.1, 90.3; 348/333.06, 373, 794
See application file for complete search history.

(56) References Cited

U.S. PATENT DOCUMENTS 1,984,297 A * 12/1934 Abell ..... 74/9
2,514,394 A * 7/1950 Irving ..... 464/57
5,100,098 A 3/1992 Hawkins
5,170,529 A * 12/1992 Kovacs ..... 16/35 R
5,436,792 A * 7/1995 Leman et al. ..... 361/679.44
5,667,179 A * 9/1997 Rosen ..... 248/278.1
5,751,548 A 5/1998 Hall et al.
5,771,539 A * 6/1998 Wahlstedt et al. ..... 16/285
5,970,819 A * 10/1999 Katoh ..... 74/531
6,124,902 A 9/2000 Rosen
6,199,810 B1 3/2001 Wu et al.
6,364,390 B1 4/2002 Finneman
6,409,242 B1 * 6/2002 Chang ..... 296/37.7
6,445,573 B1 9/2002 Portman et al.
6,529,123 B1 3/2003 Paul, Jr.
6,530,547 B1 3/2003 Wada
6,663,064 B1 * 12/2003 Minelli et al. ..... 248/205.5
6,663,155 B1 12/2003 Malone et al.
6,683,786 B2 1/2004 Yin et al.
6,724,317 B1 4/2004 Kitano et al.
2002/0149708 A1 10/2002 Nagata et al.
2003/0042378 A1 3/2003 Imamura et al.
2006/0288376 A1 * 12/2006 Vitito ..... 725/75
2008/0196204 A1 * 8/2008 Lin et al. ..... 16/341

* cited by examiner

*Primary Examiner*—Victor Batson
*Assistant Examiner*—Matthew Sullivan
(74) *Attorney, Agent, or Firm*—F. Chau & Associates, LLC

(57) ABSTRACT

A hinge for use in conjunction with an overhead mobile video system includes a pivot rod fixedly coupled to a mounting bracket, a housing pivotally mounted upon the pivot rod and a friction spring interposed between the pivot rod and the housing controlling rotation of the mounting bracket relative to the housing.

15 Claims, 7 Drawing Sheets

HINGE FOR A MOBILE VIDEO SYSTEM

BACKGROUND OF THE INVENTION

1. Field of the Invention

Briefly, the invention relates to a hinge structure for use in conjunction with an overhead mobile video system. More particularly, the invention relates to a hinge structure employing frictional resistance to control the movement of a video monitor housing relative to the overhead support of the automobile in an efficient and reliable manner.

2. Description of the Related Art

Many overhead mobile video systems allow a user to rotate the video monitor between and opened orientation allowing viewing from the backseat of an automobile and a closed orientation wherein the video monitor is hidden from view. Controlled rotation that is, the ability of one to orient a video monitor in a desired orientation and have it remain in that orientation, of the video monitor as it is swung between its opened orientation and its closed orientation is made more difficult when one considers the vibrations encountered within and automobile and the wide range of people who might attempt to rotate the video monitor between its opened orientation and its closed orientation.

As such, a need exists for an improved hinge structure allowing controlled rotation of a video monitor between an opened configuration and a closed configuration. The present invention provides such a hinge structure.

SUMMARY OF THE INVENTION

It is, therefore, an object of the present invention to provide a hinge for use in conjunction with an overhead mobile video system. The hinge includes a pivot rod fixedly coupled to a mounting bracket, a housing pivotally mounted upon the pivot rod and a friction spring interposed between the pivot rod and the housing controlling rotation of the mounting bracket relative to the housing.

It is also an object of the present invention to provide a hinge wherein the friction spring is wrapped around the pivot rod for selective frictional engagement therewith.

It is another object of the present invention to provide a hinge wherein the friction spring includes a first end rigidly secured to a supporting bracket of the housing and a second end that is free for selective movement.

It is a further object of the present invention to provide a hinge wherein a cable mechanism is linked to the second end of the friction spring for selective actuation thereof.

It is also an object of the present invention to provide a hinge wherein the cable mechanism includes a lever that is rotated to actuate the friction spring releasing it from engagement with the pivot rod.

It is still another object of the present invention to provide a hinge including a biased cam interposed between the pivot rod and the housing controlling rotation thereof relative to the housing. The biased cam includes a first camming member fixedly secured to a supporting bracket of the housing and a second camming member secured to the pivot rod in a manner preventing rotational movement relative thereto but allowing axial movement thereof, wherein the biased cam further includes a spring biasing the second camming member toward the first camming member.

It is yet a further object of the present invention to provide a hinge including a safety mechanism interposed between the pivot rod and the mounting bracket, the safety mechanism includes a coil spring interposed between a supporting bracket of the housing, the pivot rod and the mounting bracket.

It is another object of the present invention to provide a hinge wherein a first end of the coil spring is fixedly coupled to the supporting bracket while a second end of the coil spring is coupled to the mounting bracket in a manner such that under normal operating conditions the pivot rod segment will not pivot relative to the mounting bracket, but when substantial force is applied to the supporting bracket this force is transmitted from the supporting bracket to the first end of the coil spring, which is fixedly connected to the supporting bracket and ultimately to the second end of the coil spring which will then temporarily disengage from a recess formed in the mounting bracket holding the coil spring relative to the mounting bracket.

It is also another object of the present invention to provide a hinge including a biased cam interposed between the pivot rod and the housing controlling rotation of the mounting bracket relative to the housing.

It is still another object of the present invention to provide a hinge wherein the biased cam includes a first camming member fixedly secured to a supporting bracket of the housing and a second camming member secured to the pivot rod in a manner preventing rotational movement of the second camming member relative to the pivot rod but allowing axial movement of the second camming member relative to the pivot rod thereof.

It is a further object of the present invention to, provide a hinge wherein the biased cam further includes a spring biasing the second camming member toward the first camming member.

It is also an object of the present invention to provide a hinge wherein the first camming member and the second camming member are respectively provided with mating resistance camming surfaces that ride over one another in manner controlling relative movement between the mounting bracket and the supporting bracket.

It is another object of the present invention to provide a hinge for use in conjunction with an overhead mobile video system. The hinge includes a pivot rod fixedly coupled to a mounting bracket, a housing pivotally mounted upon the pivot rod, a biased cam interposed between the pivot rod and the housing controlling rotation of the mounting bracket relative to the housing.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
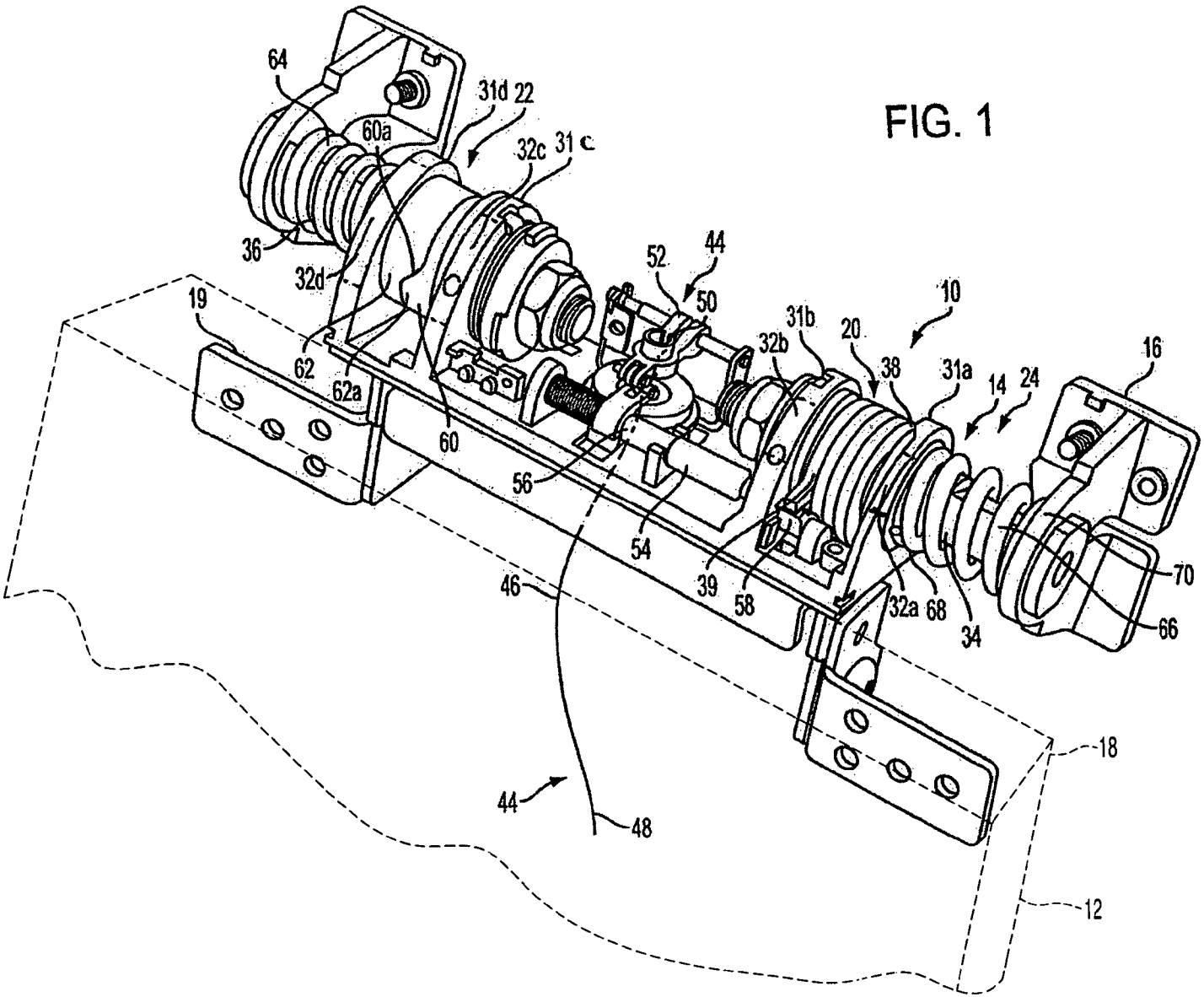
FIG. 1 is a perspective view of the present hinge.
Figure 2:
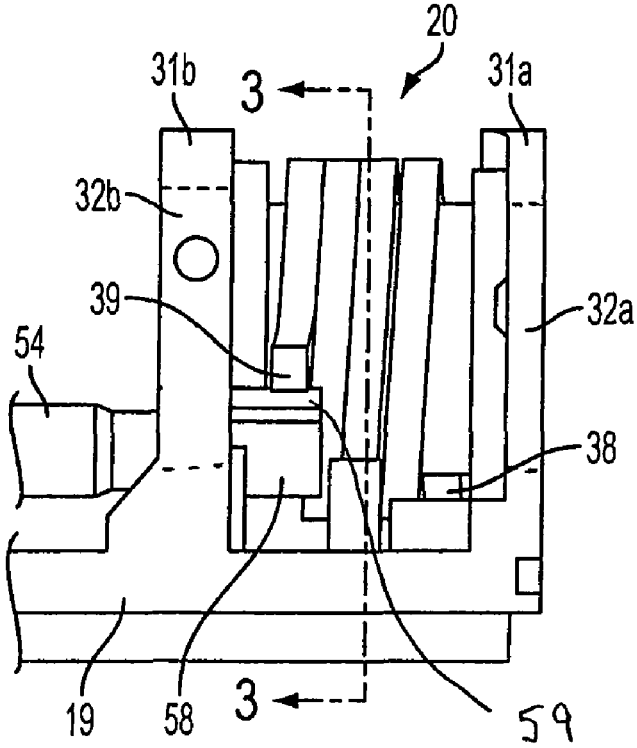
FIG. 2 is a detailed front plan view of the friction spring of the present hinge.
Figure 3:
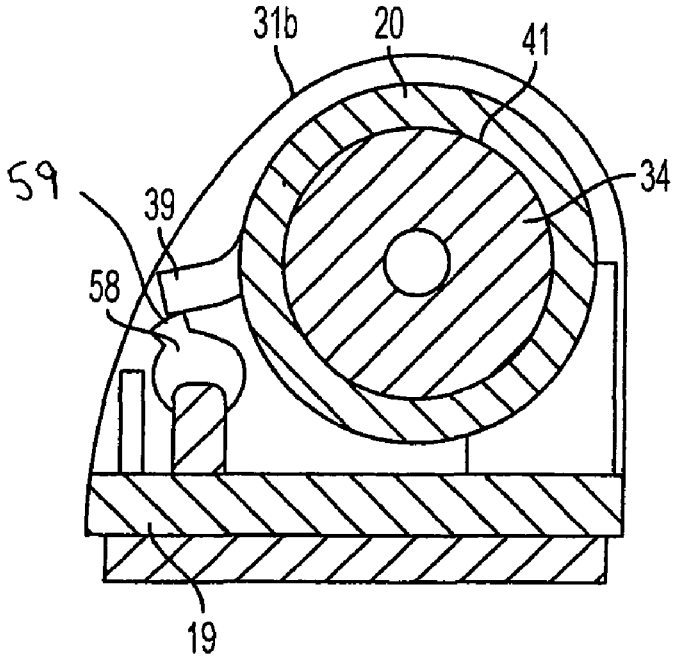
FIG. 3 is a cross sectional view along the line 3-3 in FIG. 2.

The detailed embodiment of the present invention is disclosed herein. It should be understood, however, that the disclosed embodiment is merely exemplary of the invention, which may be embodied in various forms. Therefore, the details disclosed herein are not to be interpreted as limiting, but merely as a basis for teaching one skilled in the art how to make and/or use the invention.

In accordance with the present invention, and with reference to FIGS. 1 to 9, a hinge 10 for use in conjunction with an overhead mobile video system 12 is disclosed. As those skilled in the art will certainly appreciate, the hinge 10 is encased in a hinge shroud 100 covering its working parts and providing for an aesthetically pleasing appearance as shown with reference to FIG. 8.

The hinge 10 includes a pivot rod 14 fixedly coupled to a mounting bracket 16. A housing 18 of the mobile video system 12 is pivotally mounted upon the pivot rod 14 via a supporting bracket 19. A series of control mechanisms are secured between the supporting bracket 19 (and ultimately the video system 12) and the mounting bracket 16 (which is ultimately secured to the ceiling of an automobile in accordance with a preferred embodiment). In accordance with a preferred embodiment of the present invention, the control mechanism of the present hinge 10 includes friction spring 20, a biased cam 22 and a safety mechanism 24. Briefly, and as will be discussed below in greater detail, the friction spring 20 is interposed between the pivot rod 14 and the housing 18 controlling rotation thereof relative to the housing 18; the biased cam 22 is interposed between the pivot rod 14 and the housing 18 controlling rotation thereof relative to the housing 18; and the safety mechanism 24 is interposed between the pivot rod 14 and the mounting bracket 16 allowing free movement of the video housing 18 relative to the mounting bracket 16 when excessive force is applied thereto. While a friction spring 20, biased cam 22 and safety mechanism 24 are disclosed in accordance with a preferred embodiment in conjunction with a single hinge, it is contemplated these structures may be utilized separately or in various combinations while still remaining within the spirit of the present invention.

More particularly, the video housing 18 includes a housing structure that supports a video monitor 26 and a video source 28. The upper edge 30 of the supporting bracket 19 of the video housing 18 includes a series of bearing supports 31*a-d* including a series of respective bearing apertures 32*a-d* upon which the pivot rod 14 of the mounting bracket 16 is engaged for allowing relative movement between the supporting bracket 19 of the video housing 18 and the mounting bracket 16.

In accordance with a preferred embodiment, the pivot rod 14 is composed of a first pivot rod segment 34 and a second pivot rod segment 36. The first pivot rod segment 34 is supported for pivotal movement by the first and second bearing apertures 32*a*, 32*b* of the first and second bearing supports 31*a*, 31*b* along one side of the supporting bracket 19 while the second pivot rod segment 36 is supported for pivotal movement by the third and fourth bearing apertures 32*c*, 32*d* of the first and second bearing supports 31*c*, 31*d* along the other side of the supporting bracket.

With reference to FIGS. 1, 2, 3 and 6, the friction spring 20 is interposed between the pivot rod 14 and the supporting bracket 19 so as to control rotation of the supporting bracket 19 of the housing 18 relative mounting bracket 16 and about to the pivot rod 14. More particularly, the friction spring 20 is wrapped around the first pivot rod segment 34 and is positioned between the first and second bearing supports 31*a*, 31*b*. A first end 38 of the friction spring 20 is rigidly secured to the supporting bracket 19 at the first bearing support 31*a*. As a result, when the friction spring 20 engages the second pivot rod segment 36, creating frictional resistance relative thereto, the supporting bracket 19, and ultimately the housing 18, is similarly prevented from rotating about to the second pivot rod segment 36 and relative to the mounting bracket 16. However, the second end 39 of the friction spring 20 is not secured to anything and movement thereof in a predetermined direction will cause the inner diameter 40 of the friction spring 20 to increase in a manner releasing the inner surface 41 of the friction spring 20 from engagement with the second pivot rod segment 36 and permitting rotation of both the friction spring 20 and the supporting bracket 19 of the housing 18 relative to the mounting bracket 16 and about the second pivot rod segment 36.

The second end 39 of the friction spring 20 is provided with a projection member 42 that is selectively actuated to control the increasing of the inner diameter 40 of the friction spring 20 in a manner allowing controlled movement of the housing 18 relative to the mounting bracket 16. More particularly, as the projection member 42 is pushed or released with force tangential to the cylindrical friction spring 20 the inner diameter 40 of the friction spring 20 increases or decreases.

The projection member 42 of the friction spring 20 is actuated via a cable mechanism 44. More particularly, the cable mechanism 44 includes a cable member 46 having a first end 48 positioned for actuation by a user of the mobile video system 12. The second end 50 of the cable member 46 is wrapped around a pivoting cam member 52 supported within the housing 18. The pivoting cam member 52 is linked to a lever 54 having a first end 56 and a second end 58. The first end 56 of the lever 54 engages the pivoting cam member 52 while the second end 58 is oriented to engage the projection member 42 of the first end 38 of the friction spring 20. In accordance with a preferred embodiment, a linkage member 53 pivotally connects the pivoting cam member 52 to the first end of the lever 54 for controlled interaction between these elements as the cable member 46 is pulled as discussed below in greater detail.

These components are oriented such that when the cable member 46 is pulled downwardly, the pivoting cam member 52 rotates, which rotates the linkage member 53 and rotates the first end 56 of the lever 54. This rotation of the lever 54 causes the second end 58 of the lever 54 to rotate and the projection 59 on the second end 58 of the lever 54 engages and moves the projection member 42 at the second end 39 of the friction spring 20. When the second end 39 of the friction spring 20 is forced in this predetermined direction, the inner diameter 40 of the friction spring 20 increases thereby allowing relative movement of the friction spring 20 relative to the second pivot rod segment 36 and similarly allowing relative movement of the housing 18 relative to the second pivot rod segment 36.

Figure 4:
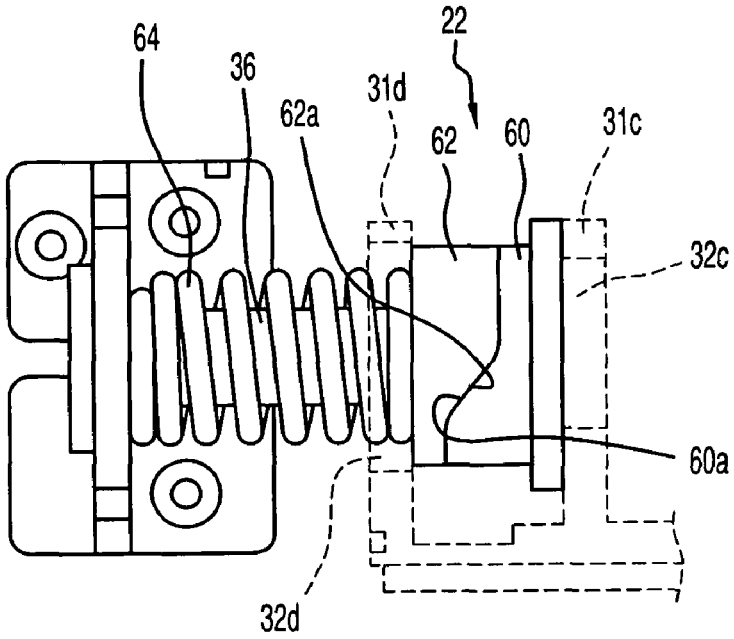
FIGS. 4 and 5 are respectively a detailed front plan view and bottom plan view showing operation of the biased cam in accordance with the present invention (including broken lines to show the working of the components in detail).
Figure 5:
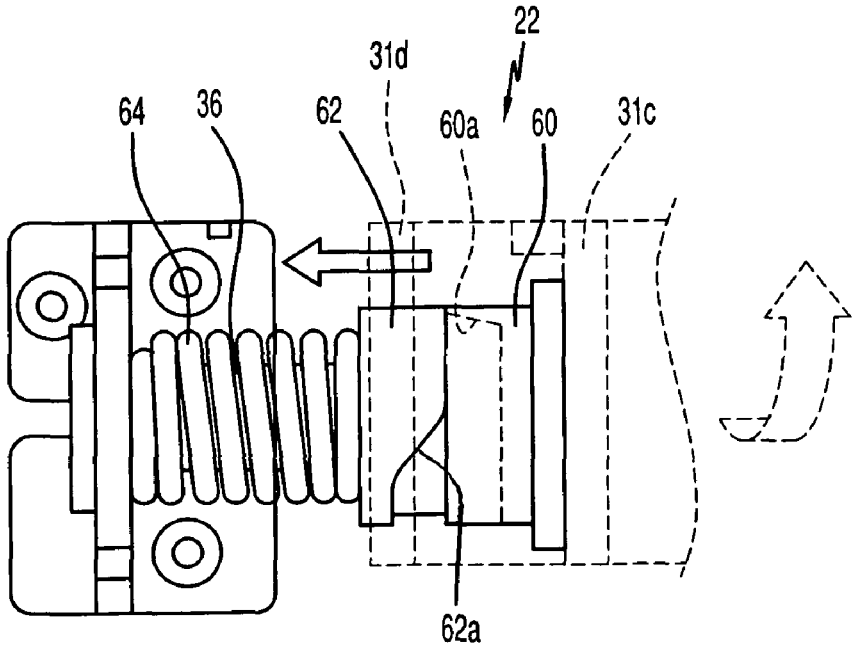
Figure 6:
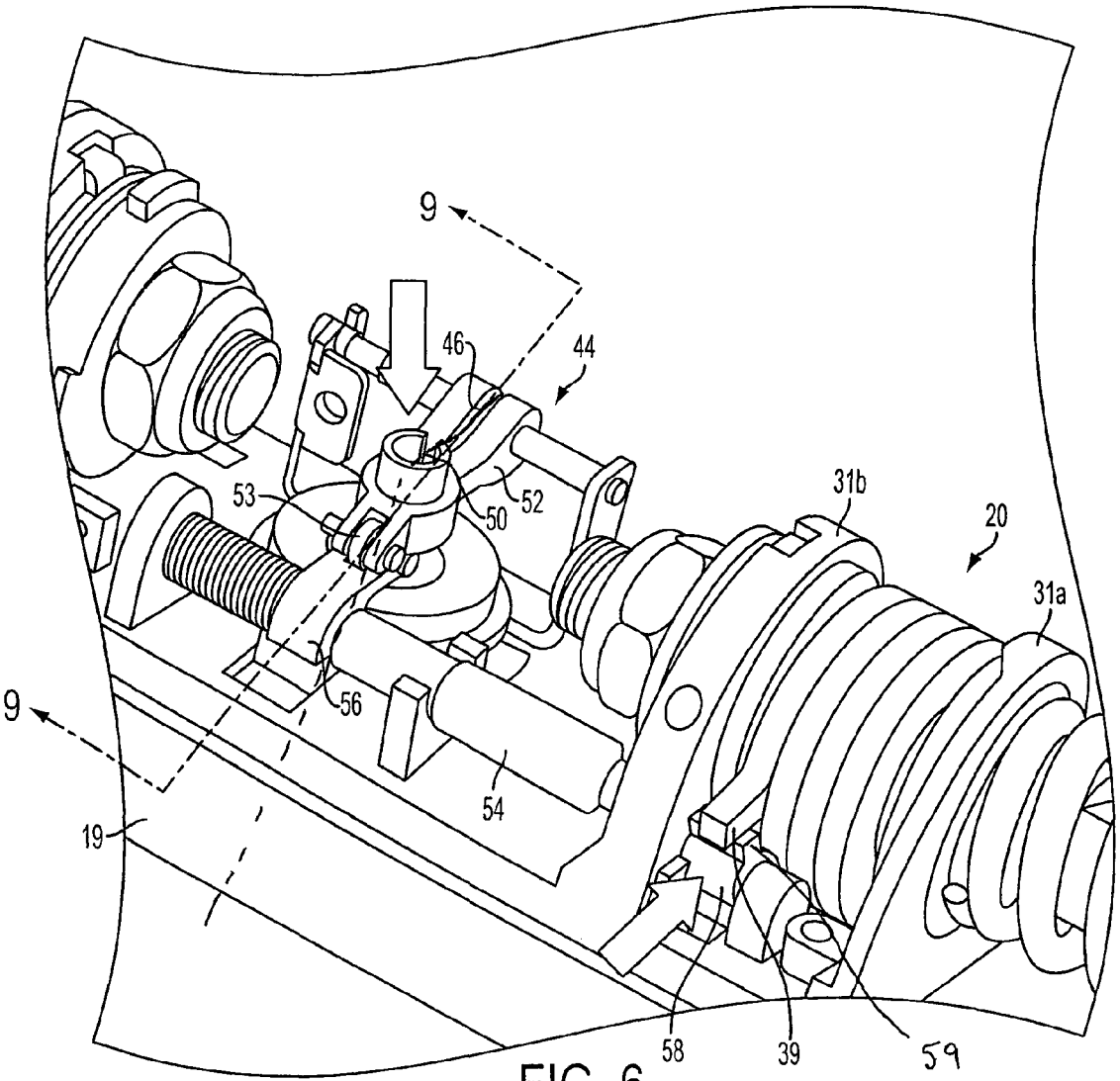
FIG. 6 is a detailed perspective view showing the cable mechanism used in actuation of the friction spring.
Figure 7:
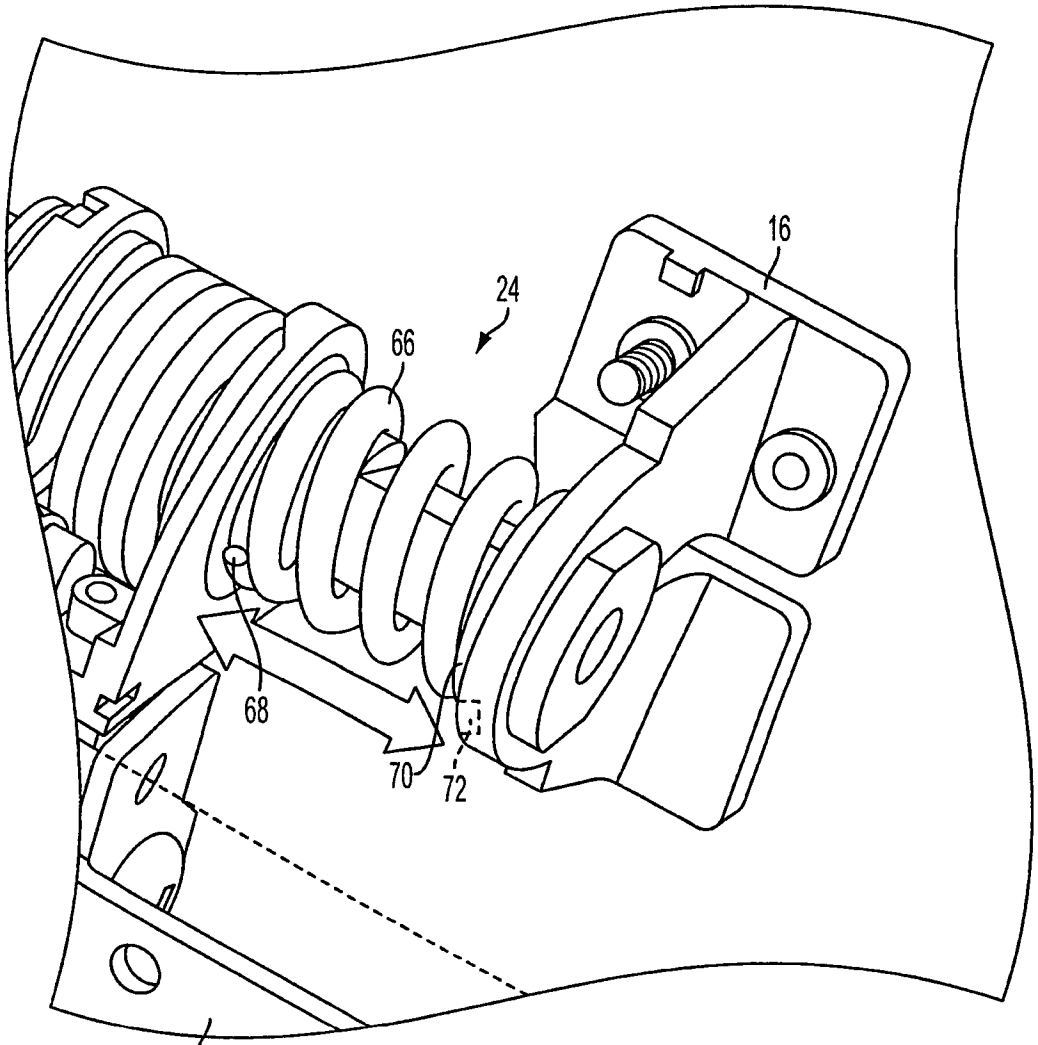
FIG. 7 is a detailed view of the safety mechanism of the present hinge.
Figure 8:
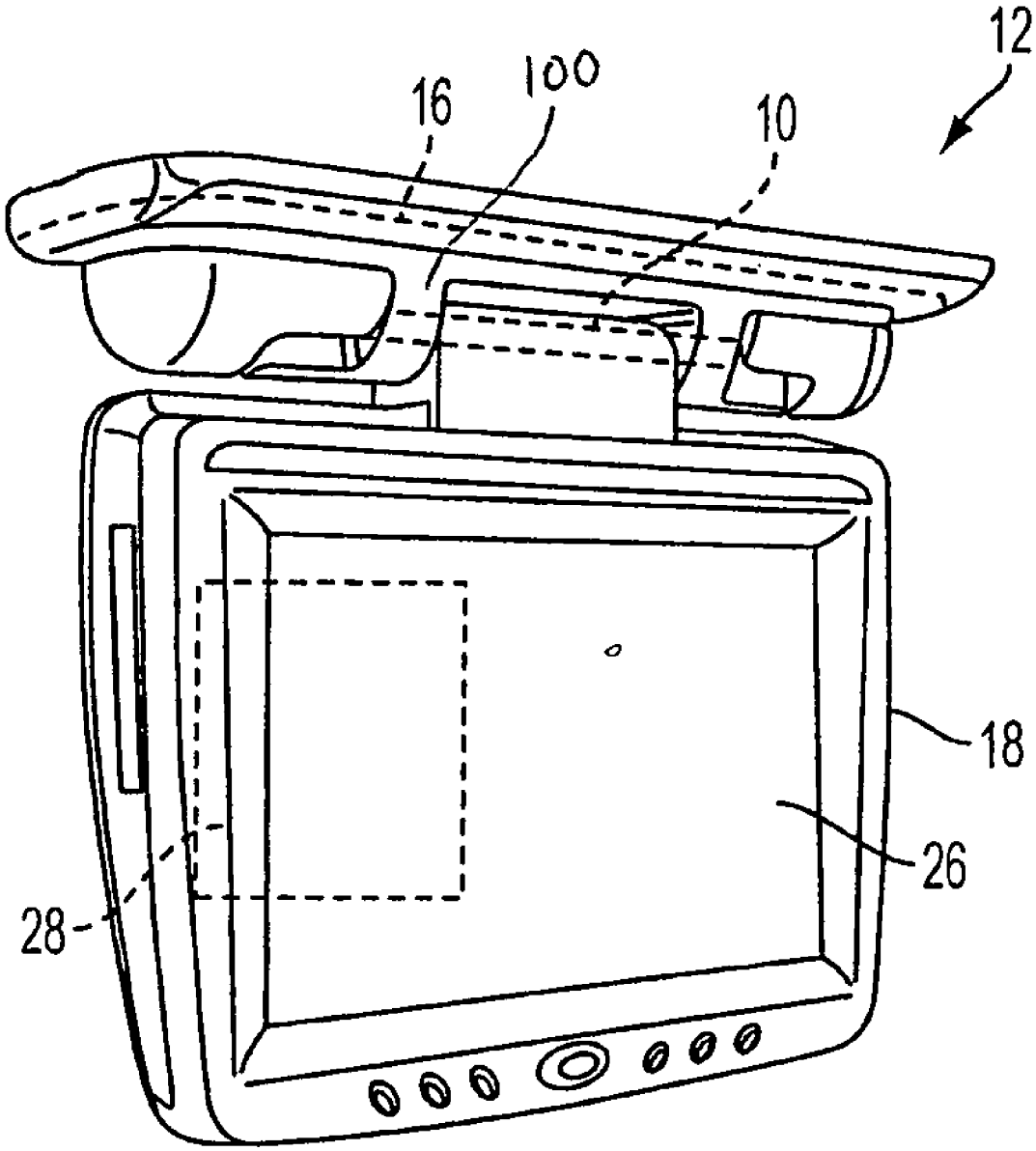
FIG. 8 is a perspective view showing a video system employing the present hinge.
Figure 9:
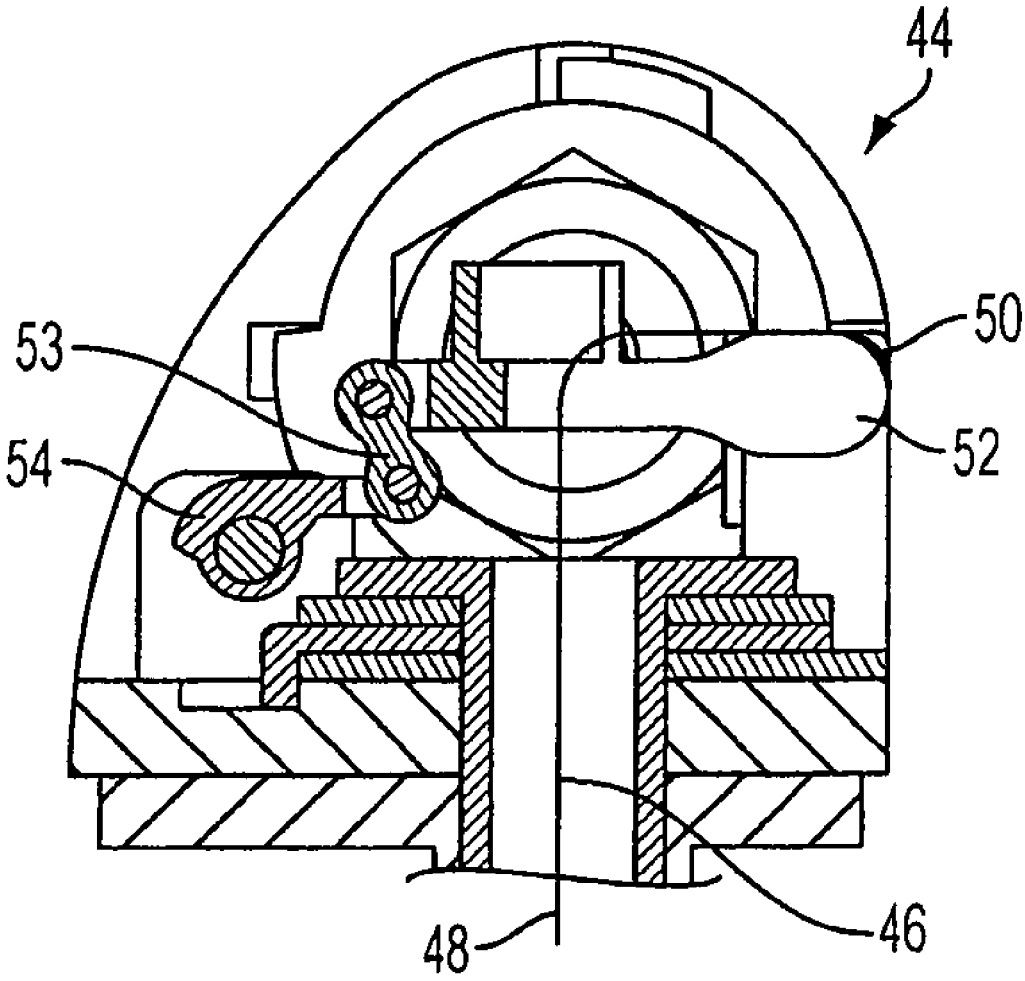
FIG. 9 is a cross sectional view along the line 9-9 in FIG. 1.

As to the biased cam 22, and with reference to FIGS. 1, 4 and 5, it includes a first camming member 60 fixedly secured to the supporting bracket 19 of the housing 18 at the third bearing support 31*c* and a second camming member 62 secured to the second pivot rod segment 36 in a manner preventing rotational movement relative thereto but allowing axial movement thereof, and a spring 64 biasing the second camming member 62 toward the first camming member 60.

The first and second camming members 60, 62 are provided with mating resistance camming surfaces 60*a*, 62*a* that ride over one another in such a way that initial movement from its storage position with the housing 18 adjacent and facing the headliner of the automobile is limited (see FIG. 4) until a sufficient application of rotational force is applied to the supporting bracket 19 to overcoming the force generated by spring 64 as it applies pressure to the mating resistance camming surfaces 60*a*, 62*a*. Once a sufficient rotational force is applied to the supporting bracket 19, and ultimately the first camming member 60, the first camming member 60 will ride over the second camming member 62, allowing the resistance camming surface 60*a* of the first camming member 60 to ride upon the resistance camming surface 62*a* of the second camming member 62 until such a time that the resistance camming surface 62*a* of the second camming member 62 reaches an apex of the first camming surface 60*a* of the first camming member 60 (see FIG. 5) at which time the spring bias being applied to the second camming member 62 by the transversely oriented spring 64 will cause the video monitor 26 to move to its use position with the housing 18 downwardly oriented for viewing by automobile passengers. Movement to the use position results from the assisted movement camming surfaces 60*a*, 62*a* of the first camming member 60 and the second camming member 62 riding over each other as the spring 64 pushes the first camming member 60 toward the second camming member 62.

When one wishes to pull down the housing 18 for use of the video system, the resistance and assistance of movement work in the opposite manner described above to initially resist the opening of the housing for use and assist in movement once the housing is close to its fully opened position. Although a spring is disclosed herein for use with the biased cam, it is contemplated resistance may be provided by a solenoid assembly within the spirit of the present invention.

In addition to the friction spring 20 and the biased cam 22, the hinge 10 is provided with a safety mechanism 24 allowing the supporting bracket 19 of the housing 18 to rotate freely relative to the mounting bracket 16 in the event substantial pressure is applied thereto which would otherwise break the housing 18. The safety mechanism 24 includes a coil spring 66 interposed between the supporting bracket 19, the second pivot rod segment 36 and the mounting bracket 16. In particular, a first end 68 of the coil spring 66 is fixedly coupled to the supporting bracket 19 while a second end 70 of the coil spring 66 is coupled to the mounting bracket 16 in a manner such that under normal operating conditions the second pivot rod segment 36 will not pivot relative to the mounting bracket 16. However, when substantial force is applied to the housing 18 and ultimately to the supporting bracket 19, this force is transmitted from the supporting bracket 19 to the first end 68 of the coil spring 66, which is fixedly connected to the supporting bracket 19 and ultimately to the second end 70 of the coil spring 66 which will then temporarily disengage from a recess 72 formed in the mounting bracket 16 holding the coil spring 66 relative to the mounting bracket 16.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A hinge for use in conjunction with an overhead mobile video system, comprising:

a pivot rod fixedly coupled to a mounting bracket;

a housing pivotally mounted upon the pivot rod;

a friction spring interposed between the pivot rod and the housing controlling rotation of the mounting bracket relative to the housing;

a biased cam interposed between the pivot rod and the housing controlling rotation thereof relative to the housing; and a safety mechanism interposed between the pivot rod and the mounting bracket, the safety mechanism includes a coil spring interposed between a supporting bracket of the housing, the pivot rod and the mounting bracket, wherein a first end of the coil spring is fixedly coupled to the supporting bracket while a second end of the coil spring is coupled to the mounting bracket such that under normal operating conditions the pivot rod will not pivot relative to the mounting bracket, but when a predetermined force is applied to the supporting bracket, the force is transmitted from the supporting bracket to the first end of the coil spring, and to the second end of the coil spring to temporarily disengage the second end of the coil spring from the mounting bracket.

2. The hinge according to claim 1, wherein the friction spring is wrapped around the pivot rod for selective frictional engagement therewith.

3. The hinge according to claim 2, wherein the friction spring includes a first end rigidly secured to a supporting bracket of the housing and a second end that is free for selective movement.

4. The hinge according to claim 3, wherein a cable mechanism is linked to the second end of the friction spring for selective actuation thereof.

5. The hinge according to claim 4, wherein the cable mechanism includes a lever that is rotated to actuate the friction spring releasing it from engagement with the pivot rod.

6. The hinge according to claim 1, wherein the biased cam includes a first camming member fixedly secured to a supporting bracket of the housing and a second camming member secured to the pivot rod in a manner preventing rotational movement of the second camming member relative to the pivot rod but allowing axial movement of the second camming member relative to the pivot rod thereof.

7. The hinge according to claim 6, wherein the biased cam further includes a spring biasing the second camming member toward the first camming member.

8. The hinge according to claim 7, wherein first camming member and the second camming member are respectively provided with mating resistance camming surfaces that ride over one another in manner controlling relative movement between the mounting bracket and the supporting bracket.

9. The hinge according to claim 1, wherein the second end of the coil spring is temporarily disengaged from a recess formed in the mounting bracket holding the coil spring relative to the mounting bracket.

10. A hinge for use in conjunction with an overhead mobile video system, comprising:

a pivot rod fixedly coupled to a mounting bracket;

a housing pivotally mounted upon the pivot rod;

a biased cam interposed between the pivot rod and the housing controlling rotation of the mounting bracket relative to the housing; and a safety mechanism interposed between the pivot rod and the mounting bracket, the safety mechanism includes a coil spring interposed between a supporting bracket of the housing, the pivot rod and the mounting bracket, wherein a first end of the coil spring is fixedly coupled to the supporting bracket while a second end of the coil spring is coupled to the mounting bracket such that under normal operating conditions the pivot rod will not pivot relative to the mounting bracket, but when a predetermined force is applied to the supporting bracket, the force is transmitted from the supporting bracket to the first end of the coil spring, and to the second end of the coil spring to temporarily disengage the second end of the coil spring from the mounting bracket.

11. The hinge according to claim 10, wherein the biased cam includes a first camming member fixedly secured to a supporting bracket of the housing and a second camming member secured to the pivot rod in a manner preventing rotational movement of the second camming member relative to the pivot rod but allowing axial movement of the second camming member relative to the pivot rod thereof.

12. The hinge according to claim 11, wherein the biased cam further includes a spring biasing the second camming member toward the first camming member.

13. The hinge according to claim 12, wherein first camming member and the second camming member are respectively provided with mating resistance camming surfaces that ride over one another in manner controlling relative movement between the mounting bracket and the supporting bracket.

14. The hinge according to claim 10, wherein the second end of the coil spring which is temporarily disengaged from a recess formed in the mounting bracket holding the coil spring relative to the mounting bracket.

15. A hinge for use in conjunction with an overhead mobile video system, comprising:

a pivot rod fixedly coupled to a mounting bracket;

a housing pivotally mounted upon the pivot rod;

a friction spring interposed between the pivot rod and the housing controlling rotation of the mounting bracket relative to the housing, wherein the friction spring is wrapped around the pivot rod for selective frictional engagement therewith; and a safety mechanism interposed between the pivot rod and the mounting bracket, the safety mechanism includes a coil spring interposed between a supporting bracket of the housing, the pivot rod and the mounting bracket, wherein a first end of the coil spring is fixedly coupled to the supporting bracket while a second end of the coil spring is coupled to the mounting bracket such that under normal operating conditions the pivot rod will not pivot relative to the mounting bracket, but when a predetermined force is applied to the supporting bracket, the force is transmitted from the supporting bracket to the first end of the coil spring, and to the second end of the coil spring to temporarily disengage the second end of the coil spring from the mounting bracket.

* * * * *